US005874934A

United States Patent [19]

Ito

[11] Patent Number: 5,874,934

[45] Date of Patent: Feb. 23, 1999

[54] SAMPLE HOLD CIRCUIT FOR LCD DRIVER

[75] Inventor: Masahiro Ito, Tokyo, Japan

[73] Assignee: NEC Corporation, Tokyo, Japan

[21] Appl. No.: 767,844

[22] Filed: Dec. 17, 1996

[30] Foreign Application Priority Data

Dec. 20, 1995 [JP] Japan ..... 7-330949

[51] Int. Cl.[6] ..... G09G 3/00

[52] U.S. Cl. ..... 345/98; 345/100

[58] Field of Search ..... 345/98, 100, 99, 345/89

[56] References Cited

U.S. PATENT DOCUMENTS

| | | | |
|---|---|---|---|
| 5,369,417 | 11/1994 | Tanaka | 345/98 |
| 5,602,561 | 2/1997 | Kawaguchi et al. | 345/99 |
| 5,680,149 | 10/1997 | Koyama et al. | 345/98 |
| 5,745,093 | 4/1998 | Tsuzuki et al. | 345/103 |

OTHER PUBLICATIONS

K. Nakajima et al., "Full–color Liquid–Crystal Display Products", *NEC Technical Journal,* vol. 46, No. 10, 1993, pp. 12–16.

*Primary Examiner*—Richard A. Hjerpe
*Assistant Examiner*—Henry N. Tran
*Attorney, Agent, or Firm*—Sughrue, Mion, Zinn, Macpeak & Seas, PLLC

[57] ABSTRACT

In order to provide a sample hold circuit used in LCD driver circuit or dividing an analog signal to parallel source driving signals in desired order with fewer numbers of elements and lower current consumption, a sample hold circuit of the invention comprises two emitter coupling logic circuit (2 and 3), each having the same number of transistors (Q2-1 to Q2-n and Q3-1 to Q3-n) with their bases controlled with outputs of a shift register (6). By connecting collectors of transistors (Q2-1 to Q2-n and Q3-1 to Q3-n) of each emitter coupling logic circuit (2 or 3) to current mirrors (4-1 to 4-n) in inverse order with each other, sample hold units (5-1 to 5-n) output sample hold signals supplied with outputs of the current mirrors (4-1 to 4-n) forward scanning or backward scanning according to the emitter coupling logic circuit (1 or 2) activated.

4 Claims, 7 Drawing Sheets

SAMPLE HOLD CIRCUIT FOR LCD DRIVER

BACKGROUND OF THE INVENTION

The present invention relates to a sample hold circuit for a LCD (Liquid Crystal Display) driver, and particularly to that to be applied in a driver circuit of a high precision LCD wherein a video picture displayed from an analog signal supplied thereto can be optionally inverted horizontally or vertically.

In a high precision LCD, high frequency input signals, that is, serial analog RGB signals for example, are generally converted into several parallel signals of low frequencies in order to be processed under frequency limit of the LCD panel.

FIG. 5 is a block diagram illustrating a basic configuration of the high precision LCD, of which an example is reported in "Full-color Liquid-Crystal Display Products" by Nakajima et al, pp. 12 to 16, NEC Technical Journal Vol. 46, No. 10/1993.

The LCD of FIG. 5 comprises;

an analog interface LSI (hereafter abbreviated as AIF) 22 supplied with an analog signal 23 for outputting four source driving signals 31-1 to 31-4, the analog signal 23 representing one of three (RGB) analog signals to be supplied to the LCD, and others omitted in FIG. 5 a first and a second source drivers 29 and 30 for activating source lines 37-1-i, 37-2-i, 37-3-i and 37-4-i of an LCD panel 36 with the source driving signals 31-1 to 31-4, i being an integer from 1 to j, a gate driver 35 for activating gate lines of the LCD panel 36, and a controller 28 for controlling the AIF 22, the first and the second source drivers 29 and 30 and the gate driver 35.

The serial to parallel conversion above mentioned is performed in the AIF 22 consisting of a preprocessor 24, a shift register 25, a sample hold circuit 26 and an output circuit 27.

The analog signal 23 is preprocessed in the preprocessor 24 with processes such as clamping or so called γ correction. The analog signal 23 is shifted by the clamping so that its black level corresponds to black level of signals to be sampled, and difference of electro-optical characteristic between the LCD and the CRT is compensated by the γ correction here.

The analog signal 23 after preprocessed in the preprocessor 24 is sampled in turn by the sample hold circuit 26 and divided into four parallel signals in order to reduce signal frequency to that able to be displayed on the LCD panel 36 controlled by the first and the second source drivers 29 and 30. In the example of FIG. 5, the analog signal 23 of high frequency is divided into four parallel signals as follows.

The controller 28 generates a dot clock 11 of a high frequency (107.5 MHz, for example) synchronized with a horizontal synchronous signal extracted from the analog signal 23 and a start pulse 12 of ¼ frequency of the dot clock 11 for regulating start timing of the dot clock 11. The shift register 25 supplies four sampling signals to the sample hold circuit 26 by shifting the start pulse 12 synchronized with the dot clock 11. With the four sampling signals, each having frequency of 26.9 MHz=107.5/4 MHz in the case and shifted with each other by one cycle of the dot clock 11, the analog signal 23 is sampled in turn and held to be output through the output circuit 27 as each of the four source driving signals 31-1 to 31-4.

In the output circuit 27, each of the four outputs of the sample hold circuit 26 is transfered into an alternation signal, alternating its polarity by every horizontal sweep for prolonging life time of liquid crystal in the LCD panel 36, and buffered to sufficiently low impedance for driving the LCD panel 36.

On the LCD panel 36, plural (j=320, for example) sets of four source lines 37-1-i, 37-2-i, 37-3-i and 37-4-i are ranged horizontally corresponding to horizontal pixels (1280=320×4 in the case). The source lines 37-1-i to 37-4-i of each i-th of the j sets are activated in order with the four source driving signals 31-1 to 31-4 respectively, controlled by the first or the second source driver 29, 30 according to a source driver control signal 38 supplied from the controller 28 synchronized with the horizontal synchronous signal. (In FIG. 5, connections among the four source driving signals 31-1 to 31-4 and the source lines 37-1-i to 37-4-i are expressed simplified in the first and the second source driver 29 and 30.)

The gate driver 35 activates gate lines (not expressed in FIG. 5) in order according to a gate driver control signal 39 generated by the controller 28 synchronized with vertical synchronous signal of the analog signal 23.

Thus, a video picture is displayed on the LCD panel 36 according to the analog signal 23 by switching each set of source lines 37-1-i to 37-4-i with the first and the second source drivers 29 and 30 at ¼ frequency of the dot clock 11.

Heretofore, an example is described, wherein the analog signal 23 is divided into four parallel signals, namely the four source driving signals 31-1 to 31-4. However, the number of the parallel signals is not limited to four, it may be eight or other number considering number of horizontal pixels and frequency limit of the LCD panel.

When the analog signal 23 is to be divided into n (n being an integer not less than 2) parallel signals, it is sampled according to n sampling signals delivered from the shift register 25, and sampled signals at every (nm+k)-th clock pulse (k being a positive integer until n and m being an increasing integer) of the dot clock 11 are held to be output as k-th source signal 31-k for activating k-th left source line 37-k-i of each i-th of j sets each having n source lines 37-1-i to 37-n-i.

In this way, a high precision LCD can be provided regardless of frequency limit of the LCD panel 36 in the example of FIG. 5.

Now, consider a case where a video picture is desired to be inverted horizontally, and also vertically in some case, for example, in order to present the video picture to a person facing to the operator by turnning the LCD panel around its horizontal axis, or for displaying a mirror picture of the operator taken with a CCD camera situated at the LCD panel.

For the purpose, the source driver(s) is sufficient to be controlled inversely, that is to activate source lines from right to left for obtaining a mirror picture, in an LCD wherein input analog signal is directly supplied without divided into parallel signals. However, in a high precision LCD as above described, in a set of source lines 37-1-i to 37-n-i, the analog signal 23 is displayed from left to right in the order, even when the first and the second source drivers 29 and 30 are controlled to activate the source lines inversely from right to left, because each k-th source line 37-k-i is still supplied with each (nm+k)-th sample of the analog signal 23.

Therefore, also the sampling signals from the shift register 25 should be controlled inversely for obtaining mirror picture, for example, so that every (nm−k+1)-th sample is held to be output for k-th source signal 31-k.

For the purpose, a bidirectional shift register is applied in a prior art.

FIG. 6 is a block diagram illustrating a bi-directional shift register composed of four D-type flip-flops 44*a* to 44*d* for controlling a sample hold circuit 26 having four sample hold elements 47*a* to 47*d* of the prior art.

In FIG. 6, all of five switching elements 45 and 45*a* to 45*d* are controlled either of A side or B side according to logic of scanning direction signal 46. When the five switching elements 45 and 45*a* to 45*d* are controlled to A side, the start pulse 12 is supplied to the most left D-type flip-flop 44*a* of the shift register 25 and shifted rightwards to the D-type flip-flops 44*b* to 44*d* in the order clocked by the dot clock 11. So, the analog signal 23 is sampled first by the most left sample hold element 47*a*, which is followed rightwards by the sample hold elements 47*b* to 47*d* in succession. When the five switching elements 45 and 45*a* to 45*d* are controlled to B side, the start pulse 12 is first delivered to the most right D-type flip-flop 44*d* to be shifted leftwards, and the analog signal 23 is sampled from right to left by the sample hold elements 47*d* to 47*a* in the order.

Thus, with the bi-directional shift register 25 of FIG. 6, the analog signal 23 can be divided into four parallel signals 31-1 to 31-4 in the order or 31-4 to 31-1 in the reverse order according to logic of the scanning direction signal 46, in the prior art.

If the switching elements can be formed on the LSI chip in a MOS process, each switching element does not cost but a transfer gate composed of two transistors. However, in LCD driver circuits, principal elements should be designed with bipolar transistors, because the LCD panel needs a high driving voltage, and a high-speed operation is demanded in the AIF 22.

FIG. 7 is a circuit diagram illustrating an example applied in the switching elements 45*a* to 45*d* of the prior art of FIG. 6.

In the example, there are provided NPN transistors Q49 and Q50 composing an emitter coupling logic circuit. When base of the NPN transistor Q49 becomes at logic HIGH by complementary scanning direction signals 48 and 49 supplied to bases of the emitter coupling logic circuit, the NPN transistor Q49 becomes ON and the NPN transistor Q50 becomes OFF, which activate a second emitter coupling logic circuit consisting of NPN transistors Q51 and Q53, and inactivate a third emitter coupling logic circuit of NPN transistors Q52 and Q54.

The second emitter coupling logic circuit activated supplied with a constant current J5, the NPN transistor Q51 becomes ON when A side input signal 51 is higher than a reference voltage 53, making emitter potential of the NPN transistor Q53 higher than the reference voltage 53. So, the NPN transistor Q53 becoming OFF, its collector potential is shifted to a power supply voltage 54, controlling emitter potential of an NPN transistor Q55 supplied with another constant current J6 to the power supply voltage minus its base-emitter voltage Vbe to be output as an output signal 55.

When the A side input signal 51 is at logic LOW being lower than the reference voltage 53, the NPN transistor Q53 becomes OFF and the collector potential of the NPN transistor Q53 is shifted to low by potential difference generated by the constant current J5 flowing through a resistor R1 from the power supply 54, which makes potential of the output signal 55 to its potential level minus base-emitter voltage Vbe of the NPN transistor Q55, that is, to logic LOW.

On the other hand, B side input signal 52 connected to the third emitter coupling logic circuit of the NPN transistors Q52 and Q54 gives no effect to the output signal 55.

On the contrary, when the third emitter coupling logic circuit of the NPN transistor Q52 and Q54 is activated and the first emitter coupling logic circuit is inactivated by inverting the complementary scanning signal 48 and 49, logic of the B side input terminal 52 is reflected to the output signal 55 in the same way.

Thus, a switching element is composed with bipolar transistors in the prior art.

However, as above described, the switching element of the bipolar transistor needs a lot of transistors. So, the bi-directional shift register manufactured in a bipolar process costs wide chip space and large current dissipation in proportion to number of D-type flip-flops therein.

This is a problem.

SUMMARY OF THE INVENTION

Therefore, a primary object of the present invention is to provide a sample hold circuit used in LCD driver circuit for dividing an analog signal to parallel source driving signals in desired order with fewer numbers of elements and lower current consumption.

In order to achieve the object, a sample hold circuit of the invention comprises:

a first emitter coupling logic circuit having a first and a second transistor, coupled emitters of said emitter coupling logic circuit grounded through biasing means and each base of said first and said second transistor supplied with each of complimentary scanning signals;

a second emitter coupling logic circuit having n transistors, coupled emitters of said second emitter coupling logic circuit connected to a collector of said first transistor, n being a positive integer;

a third emitter coupling logic circuit having n transistors, coupled emitters of said third emitter coupling logic circuit connected to a collector of said second transistor;

a shift register 6 for generating n timing pulses by shifting a start pulse synchronized with a dot clock, each i-th of said n timing pulses delayed by i clock cycle(s) from said start pulse and delivered to bases of i-th transistors of said second and said third emitter coupling logic circuits, i being a positive integer until n;

a sample hold section 5 for dividing an analog signal into parallel signals having n sample hold units, each of said n sample hold units outputting a parallel signal held therein by sampling said analog signal when a sampling signal is delivered thereto; and a current amplifying section 4 having n current amplifying means supplied with a power supply, each i-th of said n current amplifying means delivering said sampling signal to corresponding i-th of said n sample hold units when current flows through an input line thereof connected to a collector of corresponding i-th of said n transistors of said second emitter coupling logic circuit 2 together with a collector of corresponding (n−i+1)-th of said n transistors of said third emitter coupling logic circuit 3.

Therefore, a sample hold circuit of the invention can divide the analog signal to n parallel source driving signals in desired order by controlling the complementary scanning signals, with fewer numbers of elements and lower current consumption compared to the prior art.

BRIEF DESCRIPTION OF THE DRAWINGS

The foregoing, further objects, features, and advantages of this invention will become apparent from a consideration of the following description, the appended claims, and the accompanying drawings wherein the same numerals indicate the same or the corresponding parts, and:

DETAILED DESCRIPTION OF THE PREFERRED EMBODIMENTS

Now, embodiments of the present invention will be described in connection with the drawings.

Figure 1:
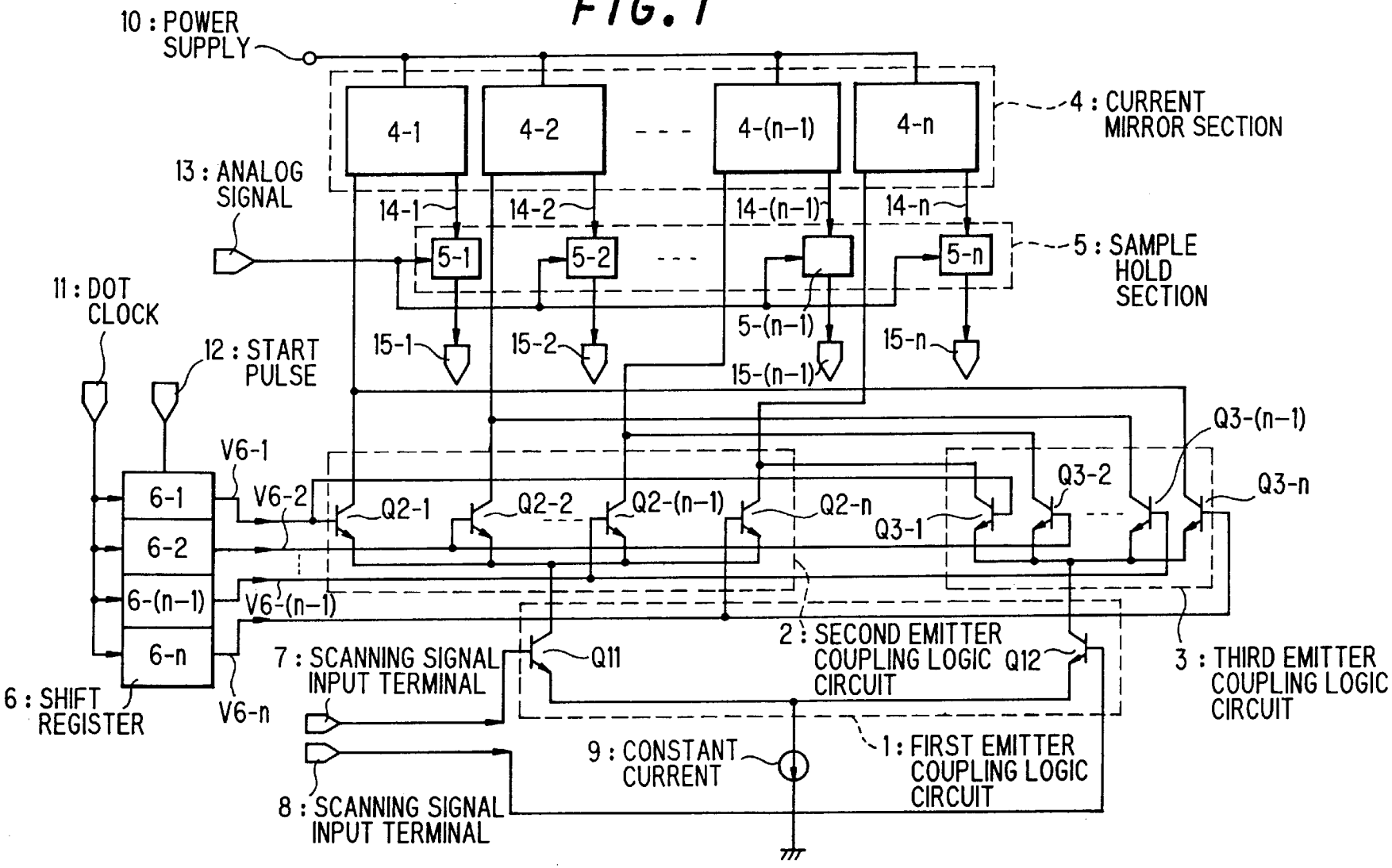
FIG. 1 is a block diagram illustrating an embodiment of the invention.
Figure 2:
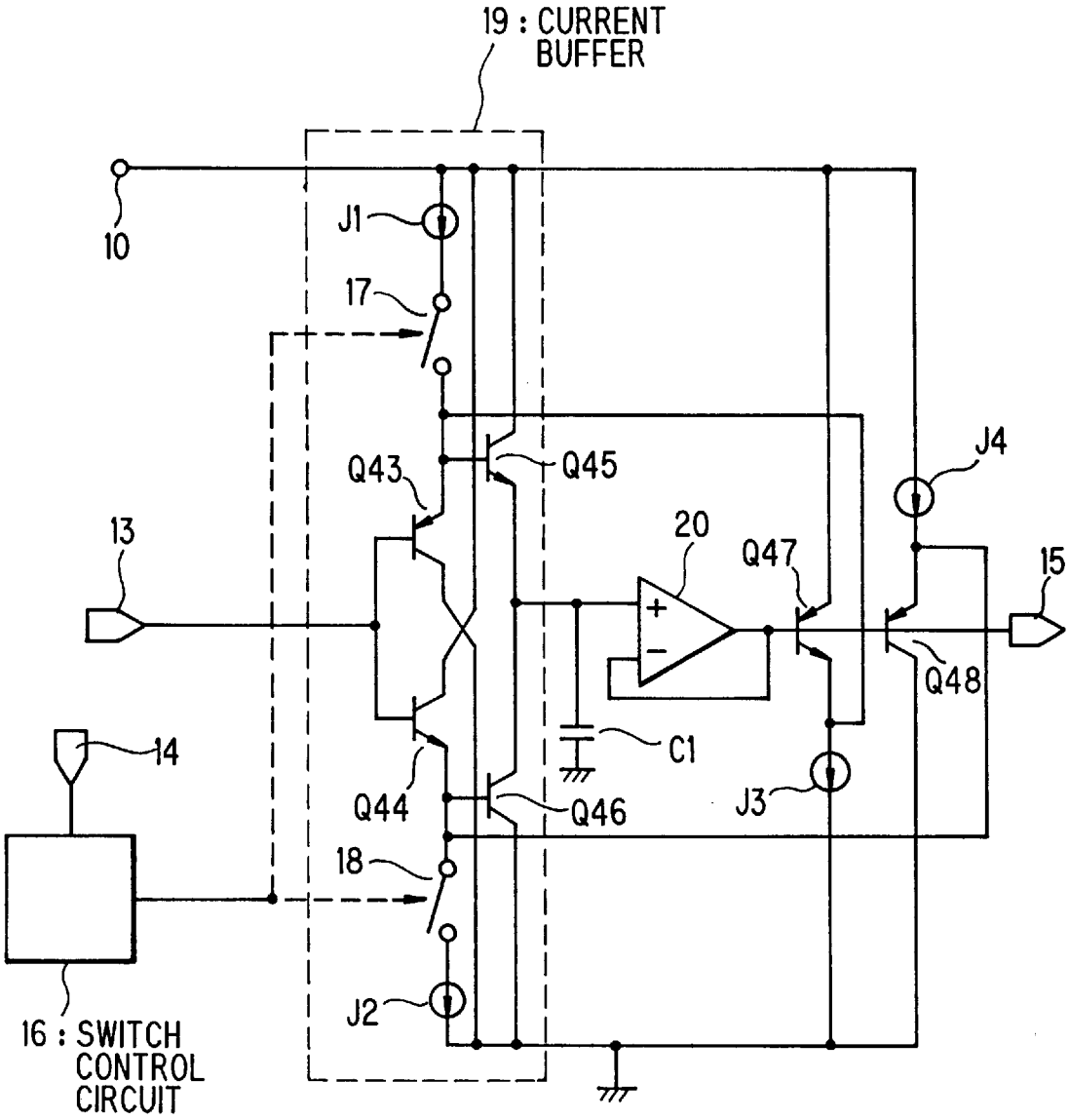
FIG. 2 is a circuit diagram illustrating an example of a sample hold unit in the sample hold section 5 of FIG. 1.

FIG. 1 is a block diagram illustrating an embodiment of the invention provided with a sample hold section 5 having a plurality (n) of sample hold units 5-1 to 5-n, for which any appropriate sample hold unit can be applied, such as an example having a circuit configuration illustrated in FIG. 2.

First, the example of FIG. 2 of a sample hold unit is described.

The sample hold unit of FIG. 2 comprises;

a current buffer 19 for charging a hold condenser C1 with potential of an analog signal 13 input therein when activated through a switch control circuit 16 with an output current 14 of a current mirror circuit in a current mirror section 4 of FIG. 1, and an operational amplifier 20 for outputting an output signal 15 having the same potential with the hold condenser C1 input to its positive input terminal, the output signal 15 being fed back to its negative input terminal, The current buffer 19 comprises;

a first PNP transistor Q43 with its emitter supplied with a power supply 10 through a first constant current J1 and a first switching element 17, its collector grounded and its base controlled by the analog signal 13, a first NPN transistor Q44 with its emitter grounded through a second constant current J2 and the second switching element 18, its collector connected to the power supply 10 and its base controlled by the analog signal 13, a second NPN transistor Q45 with its emitter connected to the hold condenser C1, its collector connected to the power supply 10 and its base connected to collector of the first PNP transistor Q43, and a second PNP transistor Q46 with its emitter connected to the hold condenser C1, its collector grounded and its base connected to collector of the first NPN transistor Q44.

When the output current 14 is supplied to the switch control circuit 16, it closes the first and the second switching elements 17 and 18 for activating the current buffer 19. So, the hold condenser C1 is charged with potential of the analog signal 13, which is buffered by the operational amplifier 20 to be output as the output signal 15.

The output signal 15 is also connected to bases of a third NPN transistor Q47 and a third PNP transistor Q48. Emitter of the third NPN transistor Q47, connected to base of the second NPN transistor Q45, is grounded through a third constant current J3 and its collector connected to the power supply 10, while emitter of the third PNP transistor Q48, connected to base of the second PNP transistor Q46, is supplied from the power supply 10 through a fourth constant current J4 and its collector grounded.

Current value of the third and the fourth constant current J3 and J4 is prepared to be smaller than that of the first and the second constant current J1 and J2. So, when the switching element 17 is closed, emitter potential of the third NPN transistor Q47 is controlled by the first NPN transistor Q43 and becomes higher than potential of the analog signal 13, that is, potential of the output signal 15, by its base-emitter voltage Vbe, making the third NPN transistor Q47 OFF, and similarly the third PNP transistor Q48 is made OFF too when the second switching element 18 is closed.

When the output current 14 is cut, the switching elements 17 and 18 become open. So the third NPN transistor Q47 and the third PNP transistor Q48 become controlled by the third and the fourth constant currents J3 and J4, respectively, and the emitter potential of them becomes lower or higher by the base-emitter voltage Vbe from the output signal 15. Therefore, base potential of the second NPN transistor Q45 and the second PNP transistor Q46 becomes lower and higher than potential of the hold condenser C1. With the second NPN transistor Q45 and the second PNP transistor Q46 thus made OFF, the potential of the hold condenser C1 is maintained, holding the potential of the output signal 15.

Thus, potential level of the analog signal 13 is sampled when the output current 14 is supplied, which is held after the output current 14 is cut, in the example of FIG. 2 of a sample hold unit.

Figure 4:
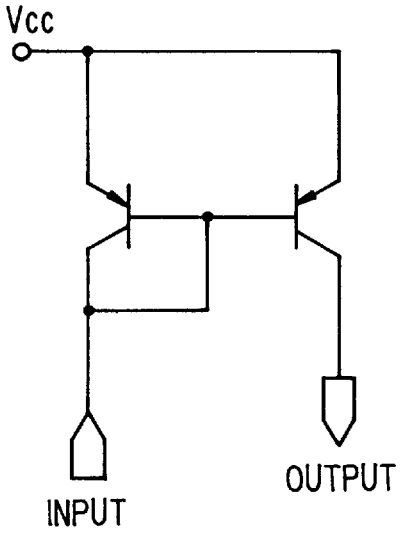
FIG. 4 is a circuit diagram of a current mirror circuit.
Figure 5:
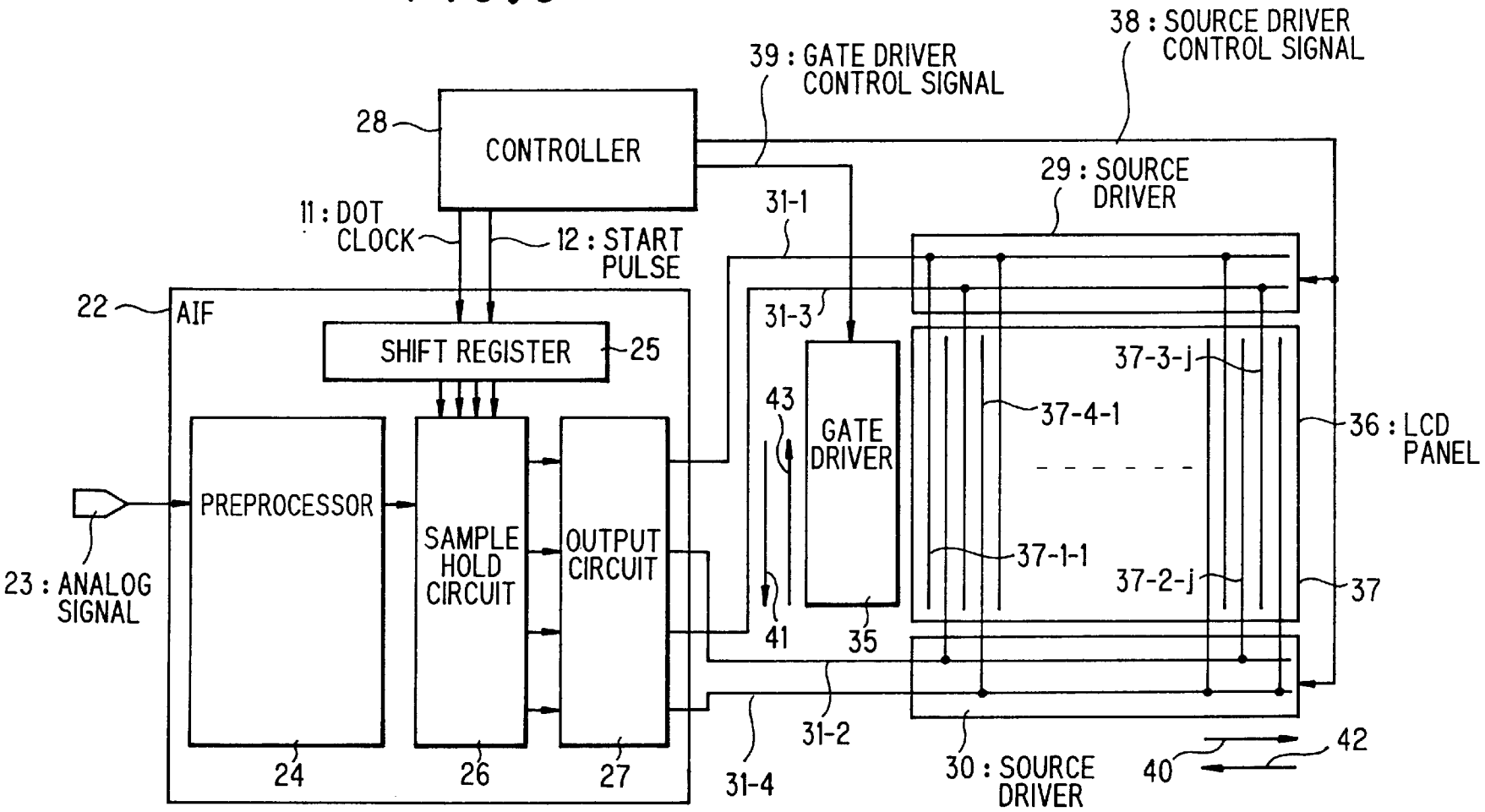
FIG. 5 is a block diagram illustrating a basic configuration of a high precision LCD.
Figure 6:
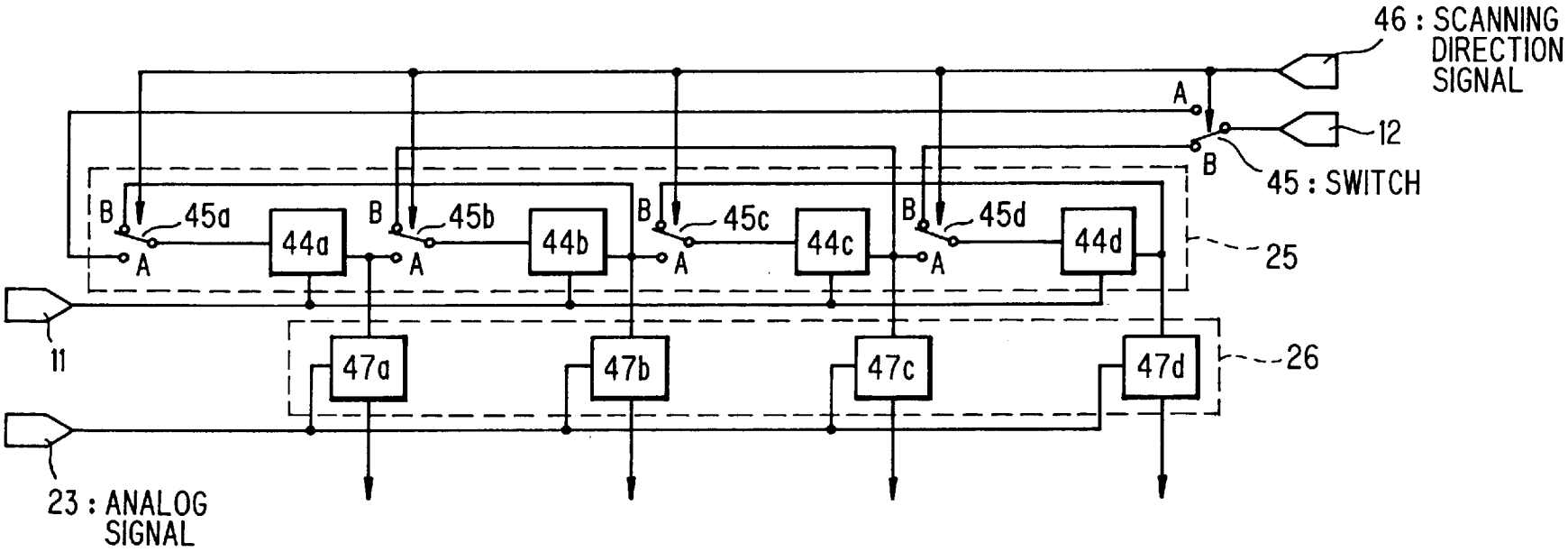
FIG. 6 PRIOR ART
FIG. 6 is a block diagram illustrating a bi-directional shift register applied in a prior art.

Now, the embodiment of the invention is described returning to FIG. 1, wherein comprised further to the sample hold section 5;

a first emitter coupling logic circuit 1, with its coupled emitters grounded through a constant current 9, consisting of a first and a second transistors Q11 and Q12, each base of the first and the second transistors Q11 and Q12 is connected to each of scanning signal input terminals 7 and 8, respectively, a second emitter coupling logic circuit 2, with its coupled emitters connected to collector of the first transistor Q11 of the first emitter coupling logic circuit 1, consisting of n transistors Q2-1 to Q2-n, n being a positive integer not less than 2, a third emitter coupling logic circuit 3, with its coupled emitters connected to collector of the second transistor Q12 of the first emitter coupling logic circuit 1, consisting of n transistors Q3-1 to Q3-n, a current mirror section 4 consisting of n current mirrors 4-1 to 4-n, of which an example of circuit configuration is illustrated in FIG. 4, supplied with a common power supply 10, input current of each i-th of the n current mirrors 4-1 to 4-n connected to collector of i-th of the n transistors Q2-1 to Q2-n of the second emitter coupling logic circuit 2 together with collector of (n−i+1)-th of the n transistors Q3-1 to Q3-n of the third emitter coupling logic circuit 3, and output current 14-i of each i-th of the n current mirrors 4-1 to 4-n delivered to switching controller 16 of i-th of the n sample hold units 5-1 to 5-n of the sample hold section 5, i being a positive integer until n, and a shift register 6 for generating n timing pulses V6-1 to V6-n by shifting a start pulse 12 synchronized with a dot clock 11, each i-th of the n timing pulses V6-1 to V6-n being delayed by i clock cycle(s) from the start pulse 12 and delivered to bases of the i-th transistors Q2-i and Q3-i of the second and the third emitter coupling logic circuits 2 and 3.

Figure 3:
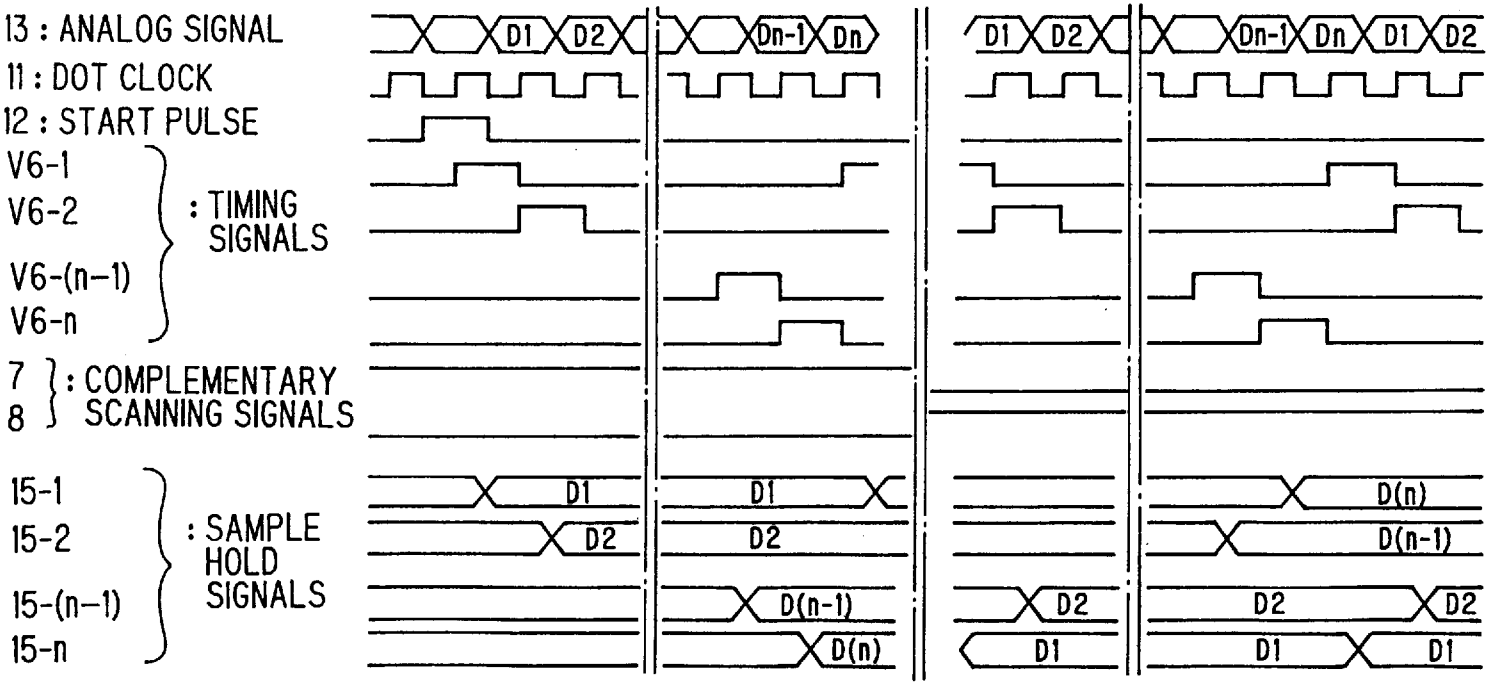
FIG. 3 is a timing chart illustrating operation of the embodiment of FIG. 1.

Now, operation of the embodiment is described referring to a timing chart of FIG. 3.

In case complementary scanning direction signals delivered to the scanning input terminals 7 and 8 indicate forward scanning by impressing higher voltage to the scanning signal input terminal 7 than the scanning signal input terminal 8, the first transistor Q11 of the first emitter coupling logic circuit 1 is turned to ON, making active the second emitter coupling logic circuit 2. The shift register 6 generates the timing pulses V6-1 to V6-n by shifting the start pulse 12 in the order synchronized with the dot clock 11, with which the n transistors Q2-1 to Q2-n of the activated emitter coupling logic circuit 2 are made ON in turn shifting in the order. Through collector of activated one, the i-th transistor Q2-i, for example, of the second emitter coupling logic circuit 2, the constant current 9 flows from corresponding current mirror 4-i, and so output current 14-i is supplied to corresponding sample hold unit 5-i.

Thus, the n sample hold units 5-1 to 5-n output n sample hold signals 15-1 to 15-n by sampling the analog signal 13 in the order, according to output currents 14-1 to 14-n supplied in turn in the order, as illustrated in left part of FIG. 3, wherein signal values D1, D2, . . . , Dn of the analog signal 13 are sampled and output into sample hold signals 15-1, 15-2, . . . , 15-n, respectively.

In case potential of the scanning signal input terminal 8 becomes higher than the scanning signal input terminal 7, indicating backward scanning, the third emitter coupling logic circuit 3 becomes active in turn with the constant current 9 flowing through the second transistor Q12 of the first emitter coupling logic circuit 1. The n transistors Q3-1 to Q3-n of the third emitter coupling logic circuit 3 are made ON in turn shifting in the order controlled by the timing pulses V6-1 to V6-n in the same way. In the case, however, collector of each i-th transistor Q3-i is connected to input current of (n−i+1)-th current mirror. So, the n current mirrors 4-1 to 4-n of the current mirror section 4 deliver output currents 14-1 to 14-n to sample hold units 5-1 to 5-n in turn in the reverse order, from 5-n to 5-1 in the case. Therefore, n sample hold signals 15-1 to 15-n where the analog signal 13 is sampled in the reverse order are obtained from the sample hold section 5, as illustrated in right part of FIG. 3, wherein signal values D1, D2, . . . , Dn of the analog signal 13 are sampled and output into sample hold signals 15-n, . . . , 15-2, 15-1, respectively.

Thus, a sample hold circuit used in LCD driver circuit for dividing an analog signal to parallel source driving signals in desired order is provided in the embodiment.

Figure 7:
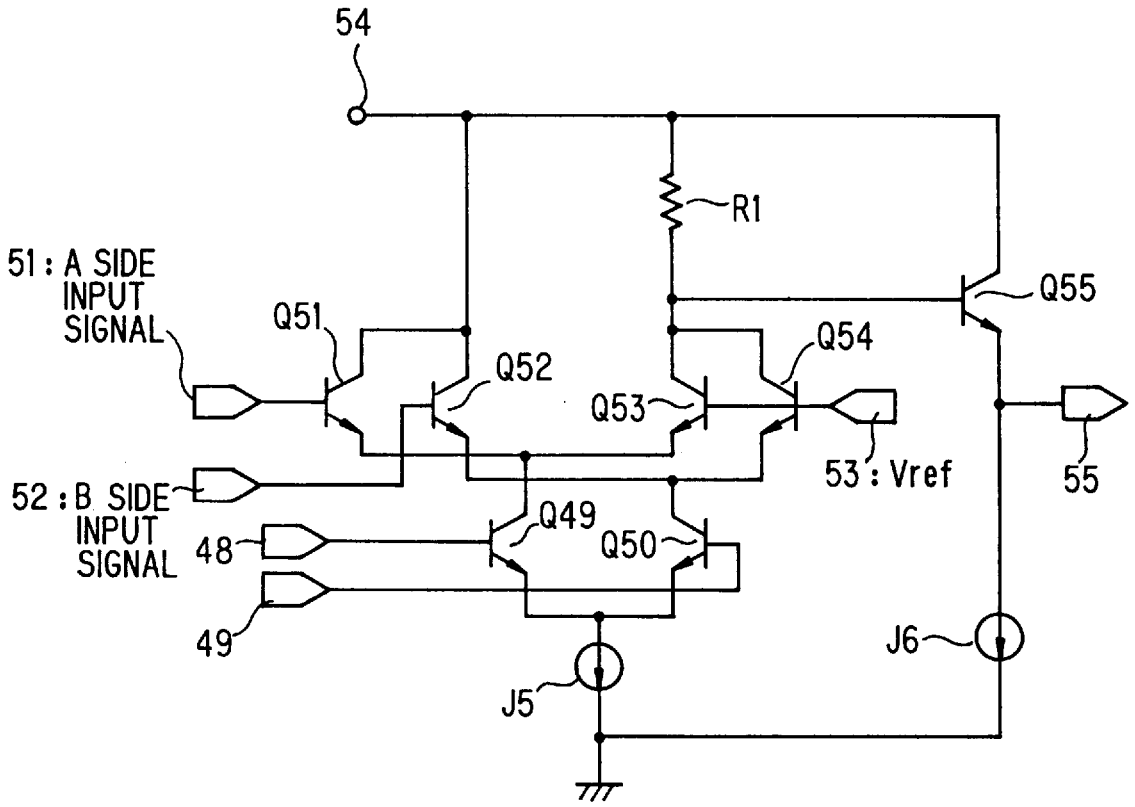
FIG. 7 PRIOR ART
FIG. 7 is a circuit diagram illustrating an example of a switching element applied in the bidirectional shift register of FIG. 6.

As apparent from the circuit configuration of FIG. 1, the sample hold circuit for dividing the analog signal into n parallel source driving signal can be realized in the embodiment by adding only a current source 9, two transistors Q11 and Q12 of the first emitter coupling logic circuit 1 and n times of four transistors, two for a current mirror and two for the second and the third emitter coupled logic circuits 2 and 3, far fewer compared to the switching element of FIG. 7 applied in the prior art.

And further, current of the embodiment flowing through the first, the second, the third emitter coupling logic circuits 1, 2 and 3 and input current lines of the current mirror section 4 is limited to the current value of the constant current 9, economizing total current consumption.

Heretofore, the present invention is described in connection with a circuit configuration of FIG. 1. However, various applications can be considered in the scope of the invention. For example, the current source 9 of FIG. 1 can be replaced with a resistor or current mirrors in the current mirror section 4 can be replaced with inverters together with polarity of switch control circuit 16 of the sample hold units in the sample hold section 5.

What is claimed is:

1. A sample hold circuit comprising:

a first emitter coupling logic circuit having a first and a second transistor, coupled emitters of said emitter coupling logic circuit grounded through biasing means and each base of said first and said second transistor supplied with each of complimentary scanning signals;

a second emitter coupling logic circuit having n transistors, coupled emitters of said second emitter coupling logic circuit connected to a collector of said first transistor, n being a positive integer;

a third emitter coupling logic circuit having n transistors, coupled emitters of said third emitter coupling logic circuit connected to a collector of said second transistor;

a shift register 6 for generating n timing pulses by shifting a start pulse synchronized with a dot clock, each i-th of said n timing pulses delayed by i clock cycle(s) from said start pulse and delivered to bases of i-th transistors of said second and said third emitter coupling logic circuits, i being a positive integer until n;

a sample hold section 5 for dividing an analog signal into parallel signals having n sample hold units, each of said n sample hold units outputting a parallel signal held therein by sampling said analog signal when a sampling signal is delivered thereto; and a current amplifying section 4 having n current amplifying means supplied with a power supply, each i-th of said n current amplifying means delivering said sampling signal to corresponding i-th of said n sample hold units when current flows through an input line thereof connected to a collector of corresponding i-th of said n transistors of said second emitter coupling logic circuit 2 together with a collector of corresponding (n-i+1)-th of said n transistors of said third emitter coupling logic circuit 3.

2. A sample hold circuit recited in claim 1, wherein each of said n current amplifying means is a current mirror circuit.

3. A sample hold circuit recited in claim 1, wherein said biasing means is a constant current circuit.

4. A sample hold circuit recited in claim 1, wherein said biasing means is a resistor.

* * * * *